US010639882B2

(12) United States Patent
Saito et al.

(10) Patent No.: US 10,639,882 B2
(45) Date of Patent: May 5, 2020

(54) TRANSFER MEMBER, IMAGE-FORMING METHOD AND IMAGE-FORMING APPARATUS

(71) Applicant: CANON KABUSHIKI KAISHA, Tokyo (JP)

(72) Inventors: Yoshikazu Saito, Inagi (JP); Mitsutoshi Noguchi, Kawaguchi (JP); Tetsuya Kosuge, Yokohama (JP); Midori Kushida, Tokyo (JP); Tsukasa Sano, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/033,483

(22) Filed: Jul. 12, 2018

(65) Prior Publication Data

US 2019/0016118 A1 Jan. 17, 2019

(30) Foreign Application Priority Data

Jul. 14, 2017 (JP) ..... 2017-138556

(51) Int. Cl.
*B41J 2/01* (2006.01)
*B41J 2/005* (2006.01)
(Continued)

(52) U.S. Cl.
CPC ..... *B41J 2/0057* (2013.01); *B41J 2/01* (2013.01); *B41J 29/17* (2013.01); *B41M 5/0017* (2013.01);
(Continued)

(58) Field of Classification Search
None
See application file for complete search history.

(56) References Cited

U.S. PATENT DOCUMENTS 5,532,724 A 7/1996 Inagaki et al.
8,690,310 B1 4/2014 Schmaelzle et al.
(Continued)

FOREIGN PATENT DOCUMENTS

JP 7-32721 A 2/1995
WO 2011/079271 A2 6/2011

OTHER PUBLICATIONS

Extended European Search Report in European Application No. 18183334.4 (dated Dec. 6, 2018).

*Primary Examiner* — Erica S Lin
(74) *Attorney, Agent, or Firm* — Venable LLP

(57) ABSTRACT

A transfer member for transfer-type image formation according to the present invention includes, in this order, a heat insulating layer, a heat storage layer and a top layer having an image formation surface, and satisfies Expressions 1 to 6: Expression 1: $0.5 \leq t1 \leq 1.5$ (t1 represents the thickness [mm] of the heat insulating layer), Expression 2: $0.05 \leq t2 \leq 0.50$ (t2 represents the thickness [mm] of the heat storage layer), Expression 3: $t3 \leq 0.020$ (t3 represents the thickness [mm] of the top layer), Expression 4: $\lambda 1 \leq 0.20$ ($\lambda$1 represents the thermal conductivity [W/(m·K)] of the heat insulating layer), Expression 5: $\lambda 2 \geq 0.23$ ($\lambda$2 represents the thermal conductivity [W/(m·K)] of the heat storage layer), and Expression 6: $C2 \geq 1.52$ (C2 represents the volume specific heat [MJ/($m^3$·K)] of the heat storage layer).

19 Claims, 2 Drawing Sheets

(51) Int. Cl.
*B41M 5/00* (2006.01)
*B41J 29/17* (2006.01)
*B41M 5/025* (2006.01)

(52) U.S. Cl.
CPC ..... *B41J 2002/012* (2013.01); *B41M 5/0256* (2013.01)

(56) References Cited

U.S. PATENT DOCUMENTS 8,871,337 B2 10/2014 Kushida et al.
9,102,137 B2 8/2015 Koitabashi et al.
9,180,659 B1 11/2015 Condello
9,815,270 B2 11/2017 Saito et al.
9,815,271 B2 11/2017 Kushida et al.
10,005,272 B2 6/2018 Noguchi et al.
2001/0019678 A1* 9/2001 Haneda ..... G03G 15/2053 399/333
2005/0141920 A1* 6/2005 Sato ..... G03G 15/5008 399/167
2006/0203019 A1* 9/2006 Yamanobe ..... B41J 2/2114 347/12
2009/0027473 A1* 1/2009 Taniuchi ..... B41J 2/0057 347/103
2009/0079807 A1* 3/2009 Yamashita ..... B41J 2/0057 347/102
2012/0308279 A1* 12/2012 Tanaka ..... G03G 15/2053 399/329
2012/0328341 A1* 12/2012 Okayasu ..... G03G 15/2042 399/329
2013/0127965 A1 5/2013 Kushida et al.
2013/0155145 A1* 6/2013 Gotou ..... C09D 11/322 347/21
2014/0218424 A1 8/2014 Koitabashi et al.
2015/0024648 A1 1/2015 Landa et al.
2015/0097906 A1 4/2015 Beier et al.

* cited by examiner

TRANSFER MEMBER, IMAGE-FORMING METHOD AND IMAGE-FORMING APPARATUS

BACKGROUND OF THE INVENTION

Field of the Invention

The present invention relates to a transfer member for transfer-type image formation, an image-forming method and an image-forming apparatus.

Description of the Related Art

A transfer-type image-forming method is known in which an intermediate image is formed with ink on the image formation surface of a transfer member and the intermediate image on the transfer member is transferred to a recording medium.

Japanese Patent Application Laid-Open No. H07-32721 discloses a transfer-type image-forming method in which an intermediate image is formed with an ink containing resin emulsion on a transfer member and the intermediate image is heated to the minimum film forming temperature of the resin emulsion or higher and is then transferred to a recording medium.

SUMMARY OF THE INVENTION

An object of the present invention is to provide a transfer member for transfer-type image formation that has improved durability in repeated use, and an image-forming method and an image-forming apparatus using the same.

According to one aspect of the present invention, there is provided a transfer member for transfer-type image formation, including, in this order, a heat insulating layer, a heat storage layer and a top layer, wherein when the thickness of the heat insulating layer, the thickness of the heat storage layer, and the thickness of the top layer are represented by t1, t2 and t3, respectively, the thermal conductivity of the heat insulating layer and the thermal conductivity of the heat storage layer are represented by λ1 and λ2, respectively, and the volume specific heat of the heat storage layer is represented by C2, t1, t2, t3, λ1, λ2 and C2 satisfy Expressions 1 to 6 below:

$$0.5\ [\mathrm{mm}] \leq t1 \leq 1.5\ [\mathrm{mm}], \quad \text{Expression 1:}$$

$$0.05\ [\mathrm{mm}] \leq t2 \leq 0.50\ [\mathrm{mm}], \quad \text{Expression 2:}$$

$$t3 \leq 0.020\ [\mathrm{mm}], \quad \text{Expression 3:}$$

$$\lambda 1 \leq 0.20\ [\mathrm{W/(m \cdot K)}], \quad \text{Expression 4:}$$

$$\lambda 2 \geq 0.23\ [\mathrm{W/(m \cdot K)}], \text{ and} \quad \text{Expression 5:}$$

$$C2 \geq 1.60\ [\mathrm{MJ/(m3 \cdot K)}]. \quad \text{Expression 6:}$$

According to another aspect of the present invention, there is provided an image-forming method including:

forming an intermediate image by applying an ink to an image formation surface of a transfer member;

heating the intermediate image by the transfer member from the image formation surface side; and transferring the thus heated intermediate image to a recording medium, wherein the transfer member includes, in this order, a heat insulating layer, a heat storage layer and a top layer having the image formation surface, and satisfies Expressions 1 to 6 above.

According to still another aspect of the present invention, there is provided an image-forming apparatus including:

a transfer member;

an image-forming unit that forms an intermediate image by applying an ink to an image formation surface of a transfer member;

a heating apparatus that heats the intermediate image on the transfer member by heating the transfer member from the image formation surface side; and a transfer unit that transfers the intermediate image on the transfer member to a recording medium, wherein the transfer member includes, in this order, a heat insulating layer, a heat storage layer and a top layer having the image formation surface, and satisfies Expressions 1 to 6 above.

Further features of the present invention will become apparent from the following description of exemplary embodiments with reference to the attached drawings.

DESCRIPTION OF THE EMBODIMENTS

Figure 1:
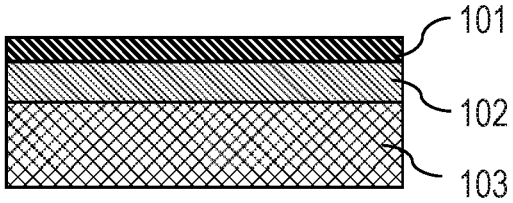
FIG. 1 is a schematic partial sectional view illustrating the structure of a transfer member according to one embodiment of the present invention.

Preferred embodiments of the present invention will now be described in detail in accordance with the accompanying drawings.

In a transfer-type image-forming method, in terms of running cost, a transfer member can be repeatedly used for image formation. However, repetition of a series of image-forming processes may cause various gradual damage to a transfer member. In particular, heat or pressure applied in a heating step or transfer step can easily damage a transfer member.

A defect portion on a surface of a transfer member due to heat or pressure causes a decrease in the image-forming performance or transfer performance of the transfer member and the resulting image scattering, poor transfer, or the like may deteriorate the quality of the image transferred to a recording medium.

The inventors have arrived, after eager study, at the present invention to suppress damage to such a transfer member being repeatedly used.

A transfer member according to the present invention includes, in this order, a top layer including a heat insulating layer, a heat storage layer and an image formation surface, and is used for transfer-type image formation.

These layers satisfy the following Expressions 1 to 6:

$$0.5\ [\mathrm{mm}] \leq t1 \leq 1.5\ [\mathrm{mm}] \quad \text{Expression 1:}$$

(t1 represents the thickness [mm] of the heat insulating layer), $$0.05\ [\mathrm{mm}] \leq t2 \leq 0.50\ [\mathrm{mm}] \quad \text{Expression 2:}$$

(t2 represents the thickness [mm] of the heat storage layer), $$t3 \leq 0.020\ [\mathrm{mm}] \quad \text{Expression 3:}$$

(t3 represents the thickness [mm] of the top layer), $$\lambda 1 \leq 0.20\ [\mathrm{W/(m \cdot K)}] \quad \text{Expression 4:}$$

(λ1 represents the thermal conductivity [W/(m·K)] of the heat insulating layer), $$\lambda 2 \geq 0.23\ [\mathrm{W/(m \cdot K)}] \quad \text{Expression 5:}$$

(λ2 represents the thermal conductivity [W/(m·K)] of the heat storage layer), and $$C2 \geq 1.60\ [\mathrm{MJ/(m^3 \cdot K)}] \quad \text{Expression 6:}$$

(C2 represents the volume specific heat [MJ/($m^3$·K)] of the heat storage layer).

An image-forming method according to the present invention includes: forming an intermediate image (also referred to as an ink image) by applying an ink to an image formation surface of a transfer member having the above-described structure; heating the intermediate image on the transfer member; and transferring the intermediate image to a recording medium.

The formation of an intermediate image can further include applying a process liquid for increasing the viscosity of the ink, to the image formation surface (also referred to as a process liquid applying step). Application of the process liquid can increase the viscosity of the ink forming the intermediate image, so that the intermediate image can be effectively fixed on the transfer member. Application of the process liquid can be performed at least one of before and after application of the ink. The ink and the process liquid are applied to the transfer member in such a manner that at least parts of the ink and the process liquid overlap with each other. In order to more effectively increase the viscosity of the ink by using the process liquid, the ink can be applied to the image formation surface of the transfer member to which the process liquid has been applied.

An image-forming apparatus according to the present invention includes: a transfer member having the above-described structure; an image-forming unit that forms an intermediate image by applying an ink to an image formation surface of a transfer member; a heating apparatus that heats the intermediate image; and a transfer unit that transfers the intermediate image on the transfer member to a recording medium.

The transfer member temporarily holds the intermediate image on the image formation surface, the image held on the transfer member is transferred to the recording medium, and a final image is formed on the recording medium. The image-forming unit includes an ink applying apparatus that applies the ink to the transfer member. The image-forming unit can further include a process liquid applying apparatus in addition to the ink applying apparatus.

It should be noted that in the present invention, an image-forming apparatus and an image-forming method in which ink is applied by the ink-jet method may be referred to as an ink-jet recording apparatus and an ink-jet recording method, respectively. In addition, a transfer member for transfer-type image formation which is used in an ink-jet recording apparatus or an ink-jet recording method may be referred to as a transfer member for transfer-type ink-jet recording. An ink-jet recording apparatus including a transfer member may be referred to as a transfer-type ink-jet recording apparatus for the sake of convenience, and an ink-jet recording method using a transfer member may be referred to as a transfer-type ink-jet recording method for the sake of convenience.

A transfer member according to the present invention will now be described.

<Transfer Member>

A transfer member includes a heat insulating layer, a heat storage layer and a top layer. The transfer member may be used for image transfer-type image formation while being supported by a support member as needed. The present inventors have found that the transfer member according to the present invention can improve durability at the repeated use of the transfer-type image forming apparatus by satisfying the requirements of the above expressions 1 to 6. The detailed mechanism for improving durability of the transfer member is not clear, but the present inventors presume as follows. In the transfer-type image formation apparatus, the transfer member having the intermediate image on the surface is heated by heating machine in order to improve transfer performance of the intermediate image at the time of transferring the intermediate image to the recording medium. The resin including in the intermediate image on the transfer member is melt-kneaded by heating the transfer member to improve adhesiveness of the intermediate image to the recording medium. As the result, the transfer performance of the intermediate image to the recording medium can be improved. However, according to study by the present inventors, it is clear that in the case of repeated use of the transfer member heated in the image forming apparatus the transfer performance is decreased and crack is generated on the surface of the transfer member. Further, the present inventors presume such disadvantage occurs by changing chemical formulation of the surface layer of the transfer member caused by heating the transfer member. Accordingly, the present inventors focused thermal performances of each layer of the transfer member in order to maintain transfer performance of the transfer member and improve durability of the transfer member. Concretely, the present inventors have achieved the present invention by studying the transfer member to retain heat from the heating machine and to suppress local heating of the surface layer. The transfer member according to the present invention has a heat storage layer satisfying the thickness t2 described in expression 2 and the volume specific heat described in expression 6, and therefore, the heat applied from the heating machine tends to be retained in the heat storage layer. Further, the transfer member according to the present invention has a heat insulating layer satisfying the thickness t1 described in expression 1 and the thermal conductivity λ1 described in expression 4, and therefore, the heat from the heat storage layer diffuses to the heat insulating layer side with difficulty and the heat of the heat storage layer tends to be retained. Furthermore, the transfer member according to the present invention has a surface layer satisfying the thickness t3 described in expression 3 and a heat storage layer satisfying the thermal conductivity λ2 described in expression 5, and therefore, the heat from the heating machine is quickly transmitted from the surface layer to the heat storage layer to suppress local heating of the surface layer of the transfer member. As the result, it is presumed that even if the transfer member heated is repeatedly used or the transfer member is heated, deterioration of the surface layer of the transfer member can be suppressed and durability in repeated use of the transfer member can be improved.

The size and shape of the transfer member can be freely selected according to the shape or size of a target image to be printed. Examples of the shape of the entire transfer member include a sheet shape, a roller shape, a drum shape, a belt shape and an endless web shape.

[Top Layer]

At least part of an open surface of the top layer of the transfer member (i.e., the surface opposite to the surface adjacent to the heat storage layer) is used as an image formation surface. A resin, ceramics, or other materials can be used as appropriate as a material constituting the top layer.

The thickness t3 of the surface layer is less than or equal to 0.020 mm as illustrated in Expression 3. If the surface layer has a thickness of more than 0.020 mm, the uniformity of the pressure to a surface of a recording medium may decrease during transfer to tend to decrease transfer performance, to retain heat in the surface layer, and to decrease durability. Further, the lower limited value of the thickness t3 of the surface layer and for example the thickness t3 of the surface layer can be 0.001 [mm]≤t3≤0.020 [mm].

Specific examples of the resin include acrylic resins, acrylic silicone resins and fluorine-containing resins. Examples of the ceramic include the condensate of a hydrolysable organosilicon compound. Other such condensates usable for forming the top layer include compounds obtained by, for example, hydrolysis or polycondensation of metal alkoxide, typically inorganic compounds obtained by the sol-gel method. Examples of metal alkoxide include compounds represented by the general formula: M(OR)n (M represents a metal such as silicon, titanium, zirconium, or aluminum; and R represents an alkyl group).

Among these materials, the condensate of a hydrolysis organic silicon compound is preferable in terms of performances in ink image formation and transfer. In addition, the condensate of a hydrolysis organic silicon compound which has a polymerization structure produced by cation polymerization, radical polymerization, or the like is more preferable in terms of durability.

If the top layer has a molecular structure containing a siloxane bond based on a hydrolysis organic silicon compound, components imparted by an ink constituting an intermediate image is effectively spread on the image formation surface of the top layer, and the intermediate image is easily released from the transfer member; thus, the transfer performance is assumed to improve.

Specific examples of hydrolysis organic silicon compound of the present invention include, but not limited to, the following: glycidoxypropyltrimethoxysilane, glycidoxypropyltriethoxysilane, glycidoxypropylmethyldimethoxysilane, glycidoxypropylmethyldiethoxysilane, glycidoxypropyldimethylmethoxysilane, glycidoxypropyldimethylethoxysilane, 2-(epoxycyclohexyl) ethyltrimethoxysilane, 2-(epoxycyclohexyl) ethyltriethoxysilane and compounds similar to these compounds but containing an oxetanyl group substituted for the epoxy group; and acryloxypropyltrimethoxysilane, acryloxypropyltriethoxysilane, acryloxypropylmethyldimethoxysilane, acryloxypropylmethyldiethoxysilane, acryloxypropyldimethylmethoxysilane, acryloxypropyldimethylethoxysilane, methacryloxypropyltrimethoxysilane, methacryloxypropyltriethoxysilane, methacryloxypropylmethyldimethoxysilane, methacryloxypropylmethyldiethoxysilane, methacryloxypropyldimethylmethoxysilane, methacryloxypropyldimethylethoxysilane, methyltrimethoxysilane, methyltriethoxysilane, dimethyldimethoxysilane, dimethyldiethoxysilane, trimethylmethoxysilane, trimethylethoxysilane, propyltrimethoxysilane, propyltriethoxysilane, hexyltrimethoxysilane, hexyltriethoxysilane, decyltrimethoxysilane and decyltriethoxysilane.

The top layer can be formed using one material selected from the aforementioned materials or a combination of two or more materials selected from the aforementioned materials.

[Heat Storage Layer]

The heat storage layer stores heat imparted from the side of the image formation surface of the top layer. The heat storage layer satisfies conditions expressed by Expression 5: λ2≥0.23 [W/(m·K)] and Expression 6: C2≥1.52 [MJ/($m^3$·K)] where the thermal conductivity of the heat storage layer is λ2 [W/(m·K)] and the volume specific heat of the heat storage layer is C2 [MJ/($m^3$·K)]. The heat storage layer satisfies conditions expressed by preferably λ2≥0.23 [W/(m·K)] (Expression 5) and C2≥1.60 [MJ/($m^3$·K)] (Expression 7), more preferably λ2≥0.27 [W/(m·K)] (Expression 8) and C2≥1.70 [MJ/($m^3$·K)] (Expression 9), particularly preferably λ2≥0.50 [W/(m·K)] (Expression 10) and C2≥2.00 [MJ/($m^3$·K)] (Expression 11). λ2 has no upper limit and may be, for example, less than or equal to 5.0 [W/(m·K)]. C2 has no upper limit and may be, for example, less than or equal to 10.0 [MJ/($m^3$·K)].

A material constituting the heat storage layer is not particularly limited and various materials, such as metal, resin, rubber, can be used as appropriate. Specific examples include aluminum, polyethylene terephthalate (PET), silicone rubber, fluorine rubber and ethylene propylene diene rubber. The heat storage layer can be formed using one material selected from the aforementioned materials or a combination of two or more materials selected from the aforementioned materials.

In addition, the heat storage layer can contain an additive that helps heat it more effectively. For example, when heating from the image formation surface side uses irradiation with near infrared rays including a wavelength of 900 nm or more and 2500 nm or less, the heat storage layer can contain an additive (which is also referred to "additive for absorbing near infrared rays") that can absorb near infrared rays for the irradiation. Specific examples of the additive for absorbing near infrared rays include organic colorants and organic compounds, such as phthalocyanine colorants, dithiolene complex compounds (metal complexes including a dithiolene ligand), squaryliumcolorants, quinone colorants and diimmonium compounds, and inorganic materials, such as carbon black, iron oxides, alumina, iron, silicon and aluminum. Each organic colorant can be used as a dye or pigment depending on its type. Each inorganic material can be used as an inorganic filler that is particulate or fibrous, for example. An example of inorganic filler of a carbon material is a carbon nanotube. The content of an additive for absorbing near infrared rays in the heat storage layer is not particularly limited as long as the content is set to obtain target heat generation and storage effects depending on the type of additive. The additive can be added such that a near infrared ray absorption rate of preferably 60% or more, more preferably 80% or more is obtained at a wavelength of 900 nm or more and 2500 nm or less of the heat storage layer. From this point of view, the content of an additive for absorbing near infrared rays in the heat storage layer is preferably 1 mass % or more and 90 mass % or less.

The thickness t2 of the heat storage layer is 0.05 mm or more and 0.50 mm or less as illustrated in Expression 2. If the thickness of the heat storage layer is less than 0.05 mm, heat retention is difficult. If the thickness of the heat storage layer is more than 0.50 mm, high energy is required for increasing the temperature of the heat storage layer 102. The thickness t2 of the heat storage layer is preferably 0.05 mm or more and 0.30 mm or less.

When the heat storage layer is also used as an elastic layer, which will be described later, the modulus of elasticity E2 [MPa] of the heat storage layer can satisfy 1 [MPa] ≤E2≤60 [MPa] (Expression 13). The thermal conductivity λ2 and the volume specific heat C2 of the heat storage layer can be controlled by regulating the content of the additive assisting heat to be included in the heat storage layer. For example, the thermal conductivity λ2 can be increased by increasing the content of carbon black in the heat storage layer. Further, the modulus of elasticity E2 and absorption rate of near infrared rays can be also increased by increasing the content of carbon black in the heat storage layer. Further, the thermal conductivity λ2 and the volume specific heat C2 of the heat storage layer can be increased by increasing the content of alumina particle or silicon particle in the heat storage layer. Further, as compared with alumina particle, silicon particle has high thermal conductivity and low volume specific heat. Accordingly, in the case when the same amounts of alumina particle and silicon particle is added to the heat storage layer, as compared with the heat storage layer containing silicon particle, the heat storage layer containing alumina particle shows low thermal conductivity and high volume specific heat. Further, in the case when the content of alumina particle or silicon particle in the heat storage layer is increased, the modulus of elasticity E2 of the heat storage layer can be also increased.

[Heat Insulating Layer]

The heat insulating layer suppresses spreading of heat imparted from the image formation surface side downward from the heat storage layer. Expression 4: λ1≤0.20 [W/(m·K)] is satisfied when the thermal conductivity of the heat insulating layer is λ1 [W/(m·K)]. λ1 has no lower limit and may be, for example, 0.03 [W/(m·K)] or more.

The thickness t1 of the heat insulating layer is 0.5 mm or more and 1.5 mm or less as illustrated in Expression 1. When the thickness of the heat insulating layer is less than 0.5 mm, adequate suppression of spreading of heat to the heat storage layer cannot be obtained. When the thickness of the heat insulating layer is more than 1.5 mm, suppression of variations in the thickness of the heat insulating layer is difficult, and non-uniformity in pressure during transfer may occur. Further, the thickness t1 of the heat insulating layer is preferably 0.5 mm or more and 1.0 mm or less.

A material constituting the heat insulating layer is not particularly limited and various heat-insulating materials, such as a metal, a resin and rubber, can be used as appropriate. In particular, a porous material, which exhibits excellent heat-insulating performance, is preferred. Specific examples include various sponge and various foam materials such as a foam metal, a foam resin. In addition, examples of foamed metal include foamed aluminum, and examples of foamed resin include foamed polyurethane, foamed polystyrene and foamed polyolefin. The heat insulating layer can be formed using one material selected from the aforementioned materials or a combination of two or more materials selected from the aforementioned materials. Further, in order to improve heat-insulating performance, the heat insulating layer preferably contains hollow fine particle. The hollow fine particle is not limited to specific particle if the hollow is included in the inside of the particle. For example, the hollow fine particle includes hollow fine particle made by acrylic resin, styrene resin, styrene-acrylic resin, or methyl methacrylate resin. As the commercialized product of these hollow fine particles, for example, Matsumoto Microsphere Series made by Matsumoto Yushi-Seiyaku Co., Ltd, Expancel Series made by Japan Fillite Co., Ltd can be used. Further, hollow inorganic particle such as hollow silica particle may be used.

When the heat insulating layer is also used as a compressed layer, which will be described later, the modulus of elasticity E1 [MPa] of the heat insulating layer can satisfy 0.1 [MPa]≤E1≤20 [MPa]. In addition, more preferably, E1 satisfies 0.1 [MPa]≤E1≤10 [MPa] (Expression 12). The thermal conductivity λ1 of the heat insulating layer can be controlled by regulating the content of hollow fine particle to be included in the heat insulating layer. For example, the content of hollow fine particle in the heat insulating layer is increased to decrease the thermal conductivity λ1 of the heat insulating layer. Further, the content of hollow fine particle in the heat insulating layer is increased to decrease the modulus of elasticity E1 of the heat insulating layer.

[Other Layers]

A transfer member according to the present invention may include an elastic layer which is provided to allow the top layer of the transfer member to easily follow the shape of a surface of a recording medium during transfer. In order that the elastic layer may deform in such a manner that the top layer follows the recording medium in a better way, the modulus of elasticity of the elastic layer can be 1 MPa or more and 60 MPa or less.

The elastic layer can be laminated directly below the top layer, i.e., in contact with the top layer. A material constituting the elastic layer is not particularly limited and various materials such as a resin, ceramics, an elastomer and rubber can be used as appropriate. Among these materials, an elastomer and a rubber material are preferred. Specific examples of the rubber material include, silicone rubber, fluorine rubber, chloroprene rubber, urethane rubber, nitrile rubber, ethylene propylene rubber, ethylene propylene diene rubber, natural rubber, styrene rubber, isoprene rubber, butadiene rubber and nitrile butadiene rubber. In particular, silicone rubber, fluorine rubber, ethylene propylene diene rubber are preferred as the resistant to fluctuations in modulus of elasticity caused by temperature is low. One material selected from the aforementioned materials or a combination of two or more materials selected from the aforementioned materials can be used.

Alternatively, the heat storage layer may also have the function of the elastic layer. In this case, ceramics, such as alumina, silica, boron nitride, magnesium oxide, copper, aluminum and carbon nanotube; and resin materials and rubbers materials to which a metal filler is added to increase the thermal conductivity; can be favorably used as a material for the elastic layer/heat storage layer.

A transfer member of the present invention may include a compressed layer in order to obtain more stable transfer performance and durability. A preferred material constituting the compressed layer is a porous material. A compressed layer composed of a porous material exhibits volume variations in the foam portions (porous portions) due to various pressure fluctuations when being compressed, and is thus resistant to deformation in the directions other than a compression direction. In order that the compressed layer may have recoverability to obtain more stable transfer performance and durability and flexibility to adapt to pressure variations during transfer, the modulus of elasticity of the compressed layer is preferably 0.1 MPa or more and 20 MPa or less, more preferably 0.1 MPa or more and 10 MPa or less.

The compressed layer can be disposed below the elastic layer, and the heat insulating layer may also serve as a compressed layer. A material constituting the compressed layer is not particularly limited as long as the target physical properties and the like of the compressed layer can be obtained. To be specific, a porous rubber to which hollow fine particles are added or the like can be favorably used as a preferred material constituting the compressed layer.

FIG. 1 is a partial cross-sectional view of a structure according to one embodiment of a transfer member to which the present invention is applicable. The transfer member has a structure in which a top layer 101, a heat storage layer 102 and a heat insulating layer 103 in direct contact with each other are laminated in this order. The top layer 101 has an image formation surface which is opposite to the surface in contact with the heat storage layer 102.

In the case where an elastic layer is provided in the structure illustrated in FIG. 1, the elastic layer can be provided between the top layer 101 and the heat storage layer 102. Alternatively, the heat storage layer 102 may be given the function of an elastic layer without additional provision of an elastic layer. In the case where a compressed layer is provided, the compressed layer can be disposed between the top layer 101 and the heat storage layer 102 or between the heat storage layer 102 and the heat insulating layer 103. Alternatively, the heat insulating layer 103 may be given the function of a compressed layer without additional provision of a compressed layer.

In the case where a compressed layer is used along with an elastic layer, the compressed layer can be disposed more on the heat insulating layer 103 side than the elastic layer is. The layer structure in this case is illustrated below.

(1) The structure in which an elastic layer is disposed between the top layer 101 and the heat storage layer 102, and a compressed layer is disposed between the heat storage layer 102 and the heat insulating layer 103.

(2) The structure in which an elastic layer is disposed between the top layer 101 and the heat storage layer 102, and the heat insulating layer 103 is given the function of a compressed layer.

(3) The structure in which the heat storage layer 102 is given the function of an elastic layer, and a compressed layer is disposed between the heat storage layer 102 and the heat insulating layer 103.

(4) The structure in which the heat storage layer 102 is given the function of an elastic layer, and the heat insulating layer 103 is given the function of a compressed layer.

[Support Member]

A support member is used as needed for giving a transfer member transportability and mechanical durability. In the case of the transfer member illustrated in FIG. 1, the support member can support the heat insulating layer 103.

The support member requires structural strength needed for the accuracy of transport of the transfer member and the durability of the support member itself.

A metal, ceramics, a resin, or the like can be used as a material constituting the support member. In particular, to provide stiffness high enough to endure pressure applied during transfer and dimension accuracy, and to improve control responsibility by reducing inertia during operation, aluminum, iron, stainless steel, acetal resin, epoxy resin, polyimide, polyethylene, polyethylene terephthalate, nylon, polyurethane, silica ceramics and alumina ceramics can be used. These materials can also be used in combination. A support member in a roller shape, a drum shape, a belt shape, or the like can be used depending on the form of a recording apparatus to apply, the scheme for transfer onto a recording medium, the shape of a transfer member, and the like. Use of a transfer member supported by a support member in a drum shape or in a belt-like endless web shape allows the same transfer member to be continuously used repeatedly, which is preferred in terms of productivity.

[Image-Forming Apparatus]

Figure 2:
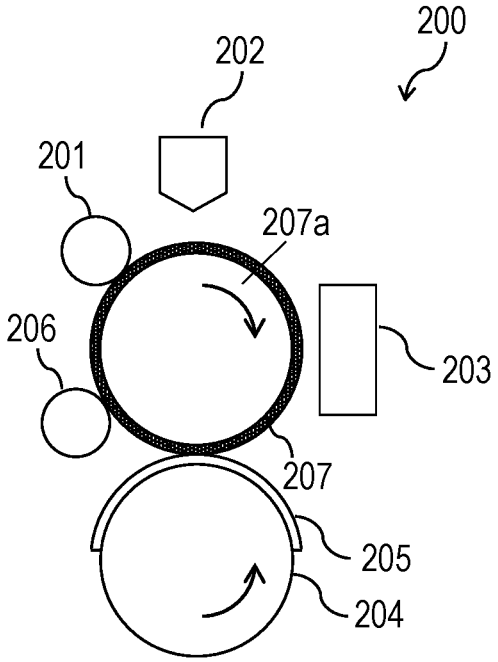
FIG. 2 is a schematic view illustrating the structure of an image-forming apparatus according to one embodiment of the present invention.

FIG. 2 is a schematic view illustrating the schematic structure of an image-forming apparatus (ink-jet recording apparatus) 200 according to one embodiment of the present invention.

The image-forming apparatus 200 includes a roll coater 201 (process liquid applying apparatus), an ink-jet recording head 202, a heater 203 (heating apparatus), a transfer member 207, a cleaning roller 206 (cleaning apparatus) and a pressurizing roller 204 (transfer unit).

The transfer member 207 is disposed on the rim of a rotatable drum-shaped support member 207*a*. The transfer member 207 rotates in the direction of the arrow and the peripheral apparatuses operate in synchronization with the rotation.

The transfer member 207 may be in any form that allows the surface of the transfer member 207 to be accessible to the recording medium 205 and that can be selected according to the form of the image-forming apparatus to apply or the conditions of transfer onto a recording medium. For example, a transfer member in a roller shape, a drum shape, or an endless belt shape is preferred for use. In particular, use of the drum-shaped transfer member 207 in the embodiment in FIG. 2 facilitates continuous and repeated use of the same transfer member 207, which is a very preferred configuration in terms of productivity.

The image-forming unit in the apparatus illustrated in FIG. 2 includes a process liquid applying section and an ink applying section. The process liquid applying section is provided with a process liquid applying apparatus including the roll coater 201. The ink applying section is provided with an ink-jet device including the ink-jet recording head 202 and serving as an ink-jet method-based ink applying apparatus. These apparatuses are disposed in this order from upstream to downstream in the direction of rotation of the transfer member 207, and a process liquid is applied to the image formation surface of the transfer member 207 before ink application. The structures of the process liquid applying apparatus and the ink applying apparatus are not limited to the structures illustrated in FIG. 2 and can be selected according to the form of the transfer member 207.

The ink-jet device may include multiple ink-jet recording heads. For example, in the case where yellow ink, magenta ink, cyan ink and black ink are used to form the respective color images, the ink-jet device includes four ink-jet recording heads for ejecting four types of the ink mentioned above, respectively, on a transfer member.

The heating apparatus includes a heater 203. The heating method or the structure for the heating apparatus are not particularly limited as long as the heating treatment of an intermediate image can be performed. Examples of the heating apparatus include a heating apparatus using heat generation by a heater or the like, and a heating apparatus emitting infrared rays or near infrared rays.

A transfer member according to the present invention includes a heat insulating layer and a heat storage layer and can use heat stored in the heat storage layer effectively for heating an intermediate image from the image formation surface side. In this embodiment, in order to store heat in the heat storage layer, the heater 203 that heat the heat storage layer of the transfer member from the image surface side is provided.

The cleaning apparatus is used to clean a surface of the transfer member 207 so that the surface can be used for the formation of the next intermediate image, in the case where the transfer member 207 is used continuously and repeatedly. In this embodiment, the cleaning apparatus cleans the image formation surface by wiping the image formation surface of the transfer member by use of a wet cleaning roller 206 brought in contact with the image formation surface. The structure of the cleaning apparatus is not limited to the structure illustrated in FIG. 2 and can be selected according to the form of the transfer member 207.

An intermediate image formed on the image formation surface of the transfer member 207 by the image-forming unit and heated by the heater 203 is pressurized on the recording medium 205 by a pressurizing roller (a pressurizing member for transfer) 204 and is transferred.

In this embodiment, a transfer unit include the pressurizing roller 204, which serves as a pressurizing member, and the support member 207*a* of the transfer member 207. The transfer member 207's rim, which includes the image formation surface, and the pressurizing roller 204's rim form a nip member for transfer. The structure of the transfer unit is not limited to the structure illustrated in FIG. 2 and can be selected according to the forms of the transfer member 207 and the recording medium 205.

[Image-Forming Method]

The summary of an image-forming method of this embodiment will now be described.

First, image data is transmitted from an image supply apparatus (not illustrated in the drawing) and the image-forming apparatus 200 is instructed to perform image recording. Subsequently, for the image data, image processing required for image formation with the ink-jet recording head 202 is performed. With the rotation of the transfer member 207, the roll coater 201 may apply a process liquid for reducing ink flowability, on a surface of the transfer member 207.

The case where an image-forming step includes a process liquid applying step and an ink applying step will now be described.

[Process Liquid Applying Step]

A process liquid (also referred to as a reaction liquid) contains a component that increases ink viscosity (ink viscosity increasing component). An increase in ink viscosity refers to a phenomenon in which a color material, resin or the like that is part of the components constituting the ink comes in contact with and thus chemically react with or physically adsorbs to an ink viscosity increasing component, thereby an increase in ink viscosity is observed. Such an increase in ink viscosity is observed not only when ink viscosity increases but also when a color material, resin or the like that is part of the components constituting the ink gathers and an increase in viscosity locally occurs. The ink viscosity increasing component is effective in reducing the flowability of ink and/or part of the components constituting ink on a recording object and thus suppressing bleeding and beading during intermediate image formation. An ink viscosity increasing component for the preparation of a process liquid is not particularly limited as long as a target increase in ink viscosity can be caused. For example, an ink viscosity increasing component to be used can be selected from the group consisting of multivalent metal ions, organic acids, cationic polymers, porous fine particles, and other known materials typically used for increasing ink viscosity, and other materials that can be used for increasing ink viscosity. One material selected from these materials or a combination of two or more materials selected from these materials can be used as an ink viscosity increasing component. Among these materials, particularly multivalent metal ions and organic acids are preferred. The process liquid can contain multiple types of ink viscosity increasing component. It should be noted that the content of an ink viscosity increasing component in the process liquid can be 5 mass % or more of the total mass of the process liquid.

Specific examples of metal ions usable as an ink viscosity increasing component include divalent and trivalent metal ions. Examples of divalent metal ions include $Ca^{2+}$, $Cu^{2+}$, $Ni^{2+}$, $Mg^{2+}$, $Sr^{2+}$, $Ba^{2+}$ and $Zn^{2+}$. Examples of trivalent metal ions include $Fe^{3+}$, $Cr^{3+}$, $Y^{3+}$ and $Al^{3-}$. Specific examples of organic acids usable as an ink viscosity increasing component include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furancarboxylic acid, bilidine carboxylic acid, coumaric acid, thiophene carboxylic acid, nicotinic acid, hydroxysuccinic acid and dioxosuccinic acid.

The process liquid may contain an appropriate amount of water and/or organic solvent. Water used in this case can be water deionized through ion exchange, for example. Organic solvent usable as a process liquid is not particularly limited and any known organic solvent can be used. Further, various resin can be added to the process liquid. Addition of an appropriate resin is preferred because it can provide a favorable degree of adhesion to a recording medium during transfer and enhance the mechanical strength and gloss of the final image. A material used is not particularly limited as long as the material can coexist with an ink viscosity increasing component. For example, a resin selected as for the process liquid from the resins used for preparation of ink described below may be used.

A surfactant or viscosity adjuster can be added to the process liquid so that its surface tension or viscosity can be adjusted for use as appropriate. A material used is not particularly limited as long as the material can coexist with an ink viscosity increasing component. For example, a cationic surfactant, an anionic surfactant, a nonionic surfactant, an amphoteric surfactant, a fluorine surfactant, a silicone surfactant, or the like can be selected. Two or more of materials selected from these materials can be used in combination.

Not only a roll coater but also a spray coater, a bar coater and other conventional apparatuses are favorably usable as the process liquid applying apparatus. A method which uses an ink-jet recording head for applying the process liquid is also favorable.

[Ink Applying Step]

The ink applying step is conducted as the next step of the process liquid applying step. Ink for image formation is selectively applied onto a surface of the transfer member 207 through the ink-jet recording head 202, thereby forming an intermediate image. Since the process liquid has been applied in advance, the applied ink comes in contact with the process liquid on the surface of the transfer member 207 and thus chemically and/or physically react with it, which reduce the flowability of the intermediate image.

The ink can contain at least one of a pigment and a dye as a color material. A dye and a pigment can be selected from those usable as a color material for ink and can be used in a necessary amount, without particularly limited. For example, a known dye, carbon black, an organic pigment or the like can be used as ink-jet ink. A material can be used in which a dye and/or pigment is dissolved and/or dispersed in a liquid medium. Among these materials, pigments which lead to high durability or quality of the printed object are preferred; thus, ink preferably contains at least a pigment as a color material. A pigment used in the ink is not particularly limited and any known inorganic pigment/organic pigment can be used. To be specific, a pigment represented by a color index (C.I.) number can be used. In addition, carbon black can be used as a black pigment. The content of a pigment in the ink is preferably 0.5 mass % or more and 15.0 mass % or less, more preferably 1.0 mass % or more and 10.0 mass % or less of the total mass of the ink.

Any dispersant for dispersing a pigment can be used as long as it is intended for use in conventionally known ink-jet recording. Among these materials, a water-soluble dispersant including both hydrophilic part and hydrophobic part in the molecular structure is preferred. In particular, a pigment dispersant which includes a resin including at least a hydrophilic monomer and a hydrophobic monomer under copolymerization can be favorably used. Each of the monomers used here may be any monomer, and a conventionally known monomer can be favorably used. Specific examples of hydrophobic monomer include styrene, styrene derivatives, alkyl (meth)acrylate and benzyl (meth)acrylate. Examples of hydrophilic monomer include acrylic acid, methacrylic acid and maleic acid.

The acid value of the dispersant can be 50 mg KOH/g or more and 550 mg KOH/g or less.

The weight-average molecular weight of the dispersant can be 1000 or more and 50000 or less. It should be noted that the mass ratio between the pigment and the dispersant can be 1:0.1 or more and 1:3 or less. Further, using a pigment made dispersible by its surface reforming, which is so-called a self-dispersing pigment, without a dispersant is favorable in this embodiment.

Ink in this embodiment may contain any type of particle that does not have a color material. In particular, resin particles are effective in improving image quality or fixability in some cases, and ink added with such resin particles is preferred. A material for such resin particles is not particularly limited and a known resin can be used as appropriate. Specific examples include polyolefin, polystyrene, polyurethane, polyester, polyether, polyurea, polyamide, polyvinyl alcohol, and poly (meth)acrylic acid, and the salts thereof, and alkyl poly (meth)acrylate, polydiene, and other homopolymers; or copolymers obtained by uniting more than one of these materials. The mass average molecular weight of the resin can be 1,000 or more and 2,000,000 or less. The content of resin particles in the ink is preferably 1 mass % or more and 50 mass % or less, more preferably 2 mass % or more and 40 mass % or less of the total mass of the ink.

The ink can be prepared using a resin particle-dispersed solution in which resin particles are dispersed. The method for dispersion of the resin particles is not particularly limited, and preferably a so-called self-dispersal resin particle-dispersed solution in which dispersion is caused using a resin of a homopolymer of a monomer having a dissociable group or a copolymer of more than one monomers having a dissociable group. Here, examples of the dissociable group include a carboxyl group, a sulfonic acid group and a phosphate group. Examples of a monomer having such a dissociable group include acrylic acid and methacrylic acid. A so-called emulsion-dispersed resin particle-dispersed solution in which dispersion is caused using an emulsifier can also be used preferably in this embodiment. An emulsifier used here is preferably a known surfactant, regardless of the low molecular mass or high molecular mass. A surfactant here is preferably nonionic or a material having the same charge as the resin fine particles. In a resin particle-dispersed solution serving as ink, resin particles are preferably in a dispersed particle size of 10 nm or more and 1000 nm or less, more preferably 100 nm or more and 500 nm or less.

For preparation of a resin particle-dispersed solution, various additive can be added for the stabilization of the resin particle-dispersed solution. Preferred examples of the additive include n-hexadecane, dodecyl methacrylate, stearyl methacrylate, chlorobenzene, dodecyl mercaptan, olive oil, blue dye (bluing agent: Blue 70) and polymethyl methacrylate.

The ink may further contain a surfactant. Specific examples of the surfactant include acetylenol EH (which is the product name, manufactured by Kawaken Fine Chemicals Co., Ltd.). The content of the surfactant in the ink can be 0.01 mass % or more and 5.0 mass % or less of the total mass of the ink.

An aqueous liquid medium containing water or a mixture of water and a water-soluble organic solvent can be used as a liquid medium in the ink. An aqueous ink can be obtained by adding a color material to an aqueous liquid medium. Water here can be water deionized through ion exchange, for example. The content of water in the ink can be 30 mass % or more and 97 mass % or less of the total mass of the ink. The type of the water-soluble organic solvent is not particularly limited and any known organic solvent can be used as the water-soluble organic solvent. Specific examples include glycerin, diethylene glycol, polyethylene glycol and 2-pyrrolidone. The content of the water-soluble organic solvent in the ink can be 3 mass % or more and 70 mass % or less of the total mass of the ink.

Apart from the components described above, the ink may contain, as needed, at least one component selected from the group consisting of a pH adjusting agent, a rust preventive agent, a preservative, a mildewproofing agent, an antioxidant, a reduction preventive agent and a water-soluble resin, and the neutralizer thereof, and various additive such as a viscosity adjuster.

[Step of Applying Auxiliary Liquid for Transfer]

In order to improve the transferability of an intermediate image formed on an image formation surface of the top layer of a transfer member, an auxiliary liquid for transfer may be applied to the intermediate image.

The auxiliary liquid for transfer is added to the intermediate image in order to improve the adhesion of an image to a recording medium at the temperature during transfer. The auxiliary liquid can contain a resin component that is effective in improving transferability and a liquid medium. A resin component used for the auxiliary liquid for transfer is not particularly limited and a resin that allows an image to have adhesion to a target recording medium can be selected from known resins. The weight-average molecular weight of a resin for the auxiliary liquid can be 1000 or more and 15000 or less approximately.

The liquid medium for the auxiliary liquid can be the material that has been given as for ink above, i.e., water or a mixture of water and a water-soluble organic solvent.

The resin for the auxiliary liquid can be the resin particles that have been given as for ink above and can be used as needed along with a water-soluble resin for dispersing resin particles.

Specific examples of the resin for the auxiliary liquid include the following resins used to impart tackiness.

(a) Vinyl-based resins.

(b) Copolymers each composed of two or more monomers, which are known as resins, selected from the group consisting of styrene and the derivative thereof, vinylnaphthalene and the derivative thereof, aliphatic alcohol esters of α, β-ethylenically unsaturated carboxylic acid, acrylic acid and the derivative thereof, maleic acid and the derivative thereof, itaconic acid and the derivative thereof, and fumaric acid and the derivative thereof; and the salts thereof.

Examples of copolymers of (b) given above include block copolymers, random copolymers and graft polymers.

Examples of the resin used to impart tackiness include solvent-soluble resins (e.g., water-soluble resins) and solvent-dispersible (including resin emulsion) resins, and the resin used to impart tackiness can be selected from them.

One of these resins can be used or two or more resins selected from them can be used in combination.

The components other than the resin used to impart tackiness can be the same components as those used in the above-described ink except the color material. The compounding ratio among these components can be close to that of the ink.

The content of resin in the auxiliary liquid is preferably 1 mass % or more and 50 mass % or less, more preferably 2 mass % or more and 40 mass % or less of the total mass of the ink.

[Heating Step]

In a heating step, which follows the ink applying step, an intermediate image on the transfer member 207 is heated. In the apparatus illustrated in FIG. 2, the support member 207*a* does not contain a heating apparatus, and the heater 203 is disposed in a position where it can heat the heat storage layer of the transfer member 207 from the image formation surface side. The heating apparatus used in the heating step is not particularly limited and may be apparatus, such as a hot-air heater or infrared-ray or near-infrared-ray heater, that can heat the heat storage layer of a transfer member from the exterior of the support member 207*a* and the transfer member 207. In particular, a heating apparatus using electromagnetic waves including near infrared rays having a wavelength of 900 nm or more and 2500 nm or less is preferred in terms of energy efficiency, responsivity and the like.

A this time, mainly the heat storage layer of the transfer member according to the present invention retains given heat quantity, and the heat insulating layer suppresses diffusion of the retained heat quantity downward from the heat insulating layer during the period before the next step, that is, a transfer step.

To be specific, the heating temperature can be 70° C. or more and 120° C. or less, considering the fact that heating the intermediate image may improve transferability and heat improves the durability of the transfer member. It should be noted that if the heating temperature is higher than 120° C., heat may damage the transfer member and the durability of the transfer member may degrade. Besides, the intermediate image may be deteriorated, and the image quality may degrade. In particular, in the state where the ink or process liquid containing an organic acid or organic solvent lies on the top layer of the transfer member, heat may cause unpredicted chemical or physical interaction between the top layer of the transfer member and the organic acid or organic solvent, so that the top layer may be altered in quality, trimmed, or subjected to hairline cracks or other defects.

[Transfer Step]

A transfer step is conducted as the next step of the heating step. In the transfer step, the recording medium 205 is pressurized on a surface of the transfer member 207, and the intermediate image is transferred onto the recording medium 205. Performing the transfer step in the state where the intermediate image is heated enhances transferability. In order to suppress the heating temperature in the heating step while obtaining good transferability in the transfer step, the length of the period between the heating step and the transfer step related to the intermediate image is preferably set as short as possible. If the thickness and thermal conductivity of the heat insulating layer of the transfer member, and the thickness, thermal conductivity, and volume specific heat of the heat storage layer of the transfer member are in ranges according to the present invention, heat supplied in the heating step can be efficiently retained until the transfer step, thereby yielding good durability and image transferability. In the apparatus illustrated in FIG. 2, the pressurizing roller 204 is used to pressurize the recording medium 205 on the transfer member 207 so that the intermediate image can be transferred. If the temperature of the intermediate image just before the pressurization is greater than or equal to the softening temperature of a component contained in the intermediate image, transfer can be efficiently performed. For example, in the case where the ink or auxiliary liquid contains a resin, the intermediate image can be heated to a temperature greater than or equal to a temperature, such as the softening temperature of the resin, at which the image containing the resin starts to be softened and transferability can thus be enhanced.

Before the transfer step, a step of removing liquids from the formed intermediate image may be performed. Removal of liquids prevents excess liquid from extending out or overflowing in the transfer step and causing image scattering or poor transfer. Any conventional method can be applied as the method for removal of liquids. To be specific, a method involving heating, a method involving blowing of low-humidity air, a method involving decompression, and a method in which an absorber is brought in contact can be used alone or in combination. Alternatively, liquids can be removed by air drying. Such a step of removing liquids may also serve as a step of heating an intermediate image.

[Cleaning Step]

The transfer member 207 is used repeatedly and continuously in view of productivity in some cases. In this case, its surface can be reconditioned before formation of the next intermediate image. Any conventional method can be used as a method for recondition. For example, a method in which a surface of the transfer member hits the shower of a cleaning liquid, a method in which a surface of the transfer member is wiped with a wet cleaning roller brought in contact with the surface, a method in which a cleaning liquid surface is brought in contact, or a method in which any of various energy is applied to a surface of the transfer member can be used. Needless to say, more than one of these methods can be used in combination. The cleaning apparatus for reconditioning an image formation surface in the apparatus illustrated in FIG. 2 includes the cleaning roller 206 and is capable of removing ink components, paper particles and the like left on the image formation surface of the transfer member 207 after transfer, from the image formation surface.

Upon completion of the aforementioned processing of image data transmitted from the image supply apparatus, this image-forming procedure ends. It should be noted that an additional step may be performed in which, a recording medium that has been subjected to image recording after transfer is pressurized with a fixing roller for increasing surface smoothness. At this time, the fixing roller may be heated to impart consistency to the image.

The present invention can provide a transfer member for transfer-type image formation that has improved durability in repeated use, and an image-forming method and an image-forming apparatus using the same.

EXAMPLE

Examples and Comparative Examples of a transfer member and an image recording method are given below to further describe the present invention in detail. It should be noted that the present invention is not limited to the following example unless otherwise set apart from the scope of the invention. Regarding content, "parts" and "%" are based on mass unless otherwise specified.

The physical properties of each layer constituting a transfer member are determined by the methods below.

(A) Layer Thickness

The cross section of the transfer member is observed using an electron microscope and the thicknesses of the heat insulating layer, the heat storage layer and the top layer are measured to determine the thickness of each layer.

(B) Thermal Conductivity

The thermal conductivities of the heat insulating layer and the heat storage layer were determined by fabricating measurement test pieces using constituent materials for the respective layers and by measuring them using a thermal conductivity measuring apparatus (product name: TPS2500S manufactured by Hot Disk AB).

(C) Volume Specific Heat

The volume specific heat were determined by fabricating test piece using a constituent material for the heat storage layer and by measuring them using a differential scanning calorimeter (product name: DSC4000 manufactured by PerkinElmer Co., Ltd.).

(D) Modulus of Elasticity

The moduli of elasticity of the heat insulating layer, the heat storage layer and the top layer were determined by fabricating measurement test pieces using constituent materials for the respective layers and by measuring them using a microhardness tester (product name: FISCHERSCOPE HM2000 manufactured by Fischer Instruments).

(E) Near Infrared Ray Absorbency Index

The near infrared ray absorbency index of the heat storage layer was determined by fabricating a measurement test piece using a constituent material for the heat storage layer and by measuring the absorbency index of near infrared rays having a wavelength of 900 nm or more and 2500 nm or less by using a near infrared ray absorptiometer (product name: NIR Quest512-5.2 manufactured by Ocean Optics).

Example 1

[Transfer Member Fabrication]

A substrate was prepared by laminating a first foundation cloth layer in which cotton yarn weaves, a rubber sponge layer including acrylonitrile rubber and a second foundation cloth layer in which cotton yarn weaves in this order by using an adhesive. To the surface of the second foundation cloth layer of this substrate, non-vulcanized silicone rubber mixed with hollow fine particles having about 60 μm of average diameter by means of vacuum stirring defoaming machine was applied by using a knife coater in a thickness of 0.5 mm, and then was vulcanized, thereby forming a heat insulating layer.

Subsequently, to silicone rubber, 5 mass % of black masterbatch, for silicone rubber which contains carbon black was added, and then spherical alumina particle with about 4 μm of average diameter was added to mix the mixture by means of vacuum stirring defoaming machine. The mixture obtained was applied to a surface of the heat insulating layer by using a knife coater in a thickness of 0.21 mm, and then was vulcanized, thereby forming a heat storage layer.

Afterwards, equimolar amounts of glycidoxypropyltriethoxysilane and methyltriethoxysilane were mixed and the mixture was refluxed and stirred in an aqueous solution for 24 hours at 100° C. To the hydrolysis condensate of organosilane obtained, 5% by mass of ADEKA ARKLS SP-150 (Trade name) was added as a photocation curing agent, and diluting the hydrolysis condensate of organosilane with a methyl isobutyl ketone mixed solvent so that the content of the hydrolysis condensate of organosilane is 27% by mass to obtain the solution of the hydrolysis condensate of organosilane.

A surface of the heat storage layer was then subjected to hydrophilic treatment using an atmospheric pressure plasma treatment apparatus. The solution of the hydrolysis condensate of organosilane was applied to the surface of the heat storage layer, which has been subjected to hydrophilic treatment, by using a slit coater, thereby forming a film. The film was irradiated with ultraviolet rays using a UV lamp (apparatus name: FUSION LIGHT HAMMER, manufactured by Alpha US Systems, peak wavelength: 365 nm, Integral of light: 1740 mJ/cm$^2$) and then heated to 120° C. in an oven for two hours for curing the film, thereby forming a top layer. Subsequently, a metal fitting for mounting on an image-forming apparatus was attached to the top layer, thereby preparing a transfer member A.

Table 1 shows the measurement results of the respective physical properties of the transfer member A.

Examples 2 to 14

Transfer members B to N having the physical properties shown in Tables 1 to 3 were fabricated in a manner similar to that for the transfer member A by adjusting the content of hollow fine particles added to the heat insulating layer, the content of the masterbatch or alumina particle added to the heat storage layer, and the thickness of each layer.

Comparative Examples 1 to 7

Transfer members O to U having the physical properties shown in Tables 4 and 5 were fabricated in a manner similar to that for the transfer member A by adjusting the content of hollow fine particles added to the heat insulating layer, the content of the masterbatch or alumina particle added to the heat storage layer, and the thickness of each layer.

TABLE 1

| | | Example 1 Transfer member A | Example 2 Transfer member B | Example 3 Transfer member C | Example 4 Transfer member D | Example 5 Transfer member E | Example 6 Transfer member F |
|---|---|---|---|---|---|---|---|
| Top layer | Thickness t3 [mm] | 0.005 | 0.005 | 0.019 | 0.005 | 0.005 | 0.005 |
| Heat storage layer | Thickness t2 [mm] | 0.21 | 0.21 | 0.21 | 0.05 | 0.21 | 0.21 |
| | Thermal conductivity λ2 [W/(m · K)] | 1.10 | 1.50 | 0.50 | 0.50 | 0.50 | 1.20 |
| | Volume specific heat C2 [MJ/(m$^3$ · K)] | 2.30 | 2.40 | 2.10 | 2.10 | 2.10 | 2.40 |
| | Modulus of elasticity E2 [MPa] | 88 | 0.3 | 11 | 11 | 11 | 1.4 |
| | 900-2500 nm Absorbency index [%] | 65 | 82 | 62 | 62 | 62 | 88 |
| Heat insulating layer | Thickness t1 [mm] | 0.5 | 0.5 | 0.5 | 0.5 | 0.5 | 0.5 |
| | Thermal conductivity λ1 [W/(m · K)] | 0.18 | 0.18 | 0.17 | 0.17 | 0.17 | 0.17 |
| | Modulus of elasticity E1 [MPa] | 12 | 12 | 5 | 5 | 5 | 5 |

TABLE 2

| | | Example 7 Transfer member G | Example 8 Transfer member H | Example 9 Transfer member I | Example 10 Transfer member J | Example 11 Transfer member K |
|---|---|---|---|---|---|---|
| Top layer | Thickness t3 [mm] | 0.005 | 0.005 | 0.005 | 0.005 | 0.005 |
| Heat storage layer | Thickness t2 [mm] | 0.21 | 0.21 | 0.21 | 0.21 | 0.21 |
| | Thermal conductivity λ2 [W/(m · K)] | 0.80 | 0.50 | 0.50 | 0.50 | 0.50 |
| | Volume specific heat C2 [MJ/(m$^3$ · K)] | 2.10 | 2.10 | 2.10 | 2.10 | 2.10 |
| | Modulus of elasticity E2 [MPa] | 57 | 11 | 11 | 11 | 11 |
| | 900-2500 nm Absorbency index [%] | 75 | 62 | 62 | 62 | 62 |
| Heat insulating layer | Thickness t1 [mm] | 0.5 | 0.5 | 0.5 | 0.5 | 0.5 |
| | Thermal conductivity λ1 [W/(m · K)] | 0.17 | 0.17 | 0.17 | 0.10 | 0.18 |
| | Modulus of elasticity E1 [MPa] | 5 | 5 | 5 | 0.5 | 8 |

TABLE 3

| | | Example 12 Transfer member L | Example 13 Transfer member M | Example 14 Transfer member N |
|---|---|---|---|---|
| Top layer | Thickness t3 [mm] | 0.005 | 0.005 | 0.005 |
| Heat storage layer | Thickness t2 [mm] | 0.11 | 0.12 | 0.21 |
| | Thermal conductivity λ2 [W/(m · K)] | 0.23 | 0.28 | 0.50 |
| | Volume specific heat C2 [MJ/(m$^3$ · K)] | 1.61 | 1.70 | 2.10 |
| | Modulus of elasticity E2 [MPa] | 10 | 13 | 11 |

TABLE 3-continued

| | | Example 12 Transfer member L | Example 13 Transfer member M | Example 14 Transfer member N |
|---|---|---|---|---|
| | 900-2500 nm Absorbency index [%] | 65 | 65 | 62 |
| Heat insulating layer | Thickness t1 [mm] | 0.5 | 0.5 | 0.5 |
| | Thermal conductivity λ1 [W/(m · K)] | 0.18 | 0.18 | 0.18 |
| | Modulus of elasticity E1 [MPa] | 12 | 12 | 0.2 |

TABLE 4

| | | Comparative Example 1 Transfer member O | Comparative Example 2 Transfer member P | Comparative Example 3 Transfer member Q | Comparative Example 4 Transfer member R | Comparative Example 5 Transfer member S |
|---|---|---|---|---|---|---|
| Top layer | Thickness t3 [mm] | 0.030 | 0.005 | 0.005 | 0.005 | 0.005 |
| Heat storage layer | Thickness t2 [mm] | 0.21 | 0.03 | 0.70 | 0.21 | 0.21 |
| | Thermal conductivity λ2 [W/(m · K)] | 0.50 | 0.50 | 0.50 | 0.20 | 0.50 |
| | Volume specific heat C2 [MJ/(m$^3$ · K)] | 2.10 | 2.10 | 2.10 | 1.55 | 2.10 |
| | Modulus of elasticity E2 [MPa] | 11 | 11 | 11 | 9 | 11 |
| | 900-2500 nm Absorbency index [%] | 62 | 62 | 62 | 70 | 62 |
| Heat insulating layer | Thickness t1 [mm] | 0.5 | 0.5 | 0.5 | 0.5 | 0.3 |
| | Thermal conductivity λ1 [W/(m · K)] | 0.17 | 0.17 | 0.17 | 0.17 | 0.17 |
| | Modulus of elasticity E1 [MPa] | 5 | 5 | 5 | 5 | 5 |

TABLE 5

| | | Comparative Example 6 Transfer member T | Comparative Example 7 Transfer member U |
|---|---|---|---|
| Top layer | Thickness t3 [mm] | 0.005 | 0.005 |
| Heat storage layer | Thickness t2 [mm] | 0.21 | 0.21 |
| | Thermal conductivity λ2 [W/(m · K)] | 0.50 | 0.50 |
| | Volume specific heat C2 [MJ/(m$^3$ · K)] | 2.10 | 2.10 |
| | Modulus of elasticity E2 [MPa] | 11 | 11 |
| | 900-2500 nm Absorbency index [%] | 62 | 62 |
| Heat insulating layer | Thickness t1 [mm] | 2.0 | 0.5 |
| | Thermal conductivity λ1 [W/(m · K)] | 0.17 | 0.22 |
| | Modulus of elasticity E1 [MPa] | 5 | 8 |

Example 15

The fabricated transfer member A was mounted to the support member 207*a* of an image-forming apparatus with the structure illustrated in FIG. 2, and an image was formed.

A process liquid was applied to a surface of the transfer member by using the roll coater 201. The method of preparing the process liquid and the composition (based on mass) are as follows.

<Preparation of Process Liquid>

The following components were mixed, and the mixture was sufficiently stirred and then subjected to pressure filtration using a cellulose acetate filter (manufactured by ADVANTEC) having a pore size of 3.0 μm, thereby preparing the process liquid.

Levulinic acid: 40.0 parts

Glycerol: 5.0 parts

MEGAFACE F444 (product name): 1.0 parts (surfactant manufactured by DIC)

Ion-exchange water: 54.0 parts

Subsequently, the ink of each color and the transfer auxiliary liquid were applied to the surface of the transfer member to which apply the process liquid in this order using the ink-jet recording head facing the surface of the transfer member. Methods of preparing the ink and transfer auxiliary liquid and the compositions of the ink and transfer auxiliary liquid are as shown in Table 5. It should be noted that a pigment was used for the ink of each color.

<Preparation of Resin Particles>

Butyl methacrylate (18.0 parts), polymerization initiator (2,2'-azobis (2-methylbutyronitrile)) (2.0 parts) and n-hexadecane (2.0 parts) were introduced into a four-neck flask having a stirrer, a reflux condenser and a nitrogen gas introduction tube, a nitrogen gas was introduced to the reaction system, and the solution was then stirred for 0.5 hours. An aqueous solution of an emulsifier (product name: NIKKOL BC15, manufactured by Nikko Chemicals) (6.0%) (78.0 parts) was dropped in this flask and the solution was stirred for 0.5 hours. Subsequently, the mixture was irradiated with ultrasound from an ultrasound radiator for three hours for emulsion. Afterwards, the mixture was subjected to polymerization reaction under a nitrogen atmosphere at 80° C. for four hours. The reaction system was cooled to 25° C., subjected to filtration of components, and then added with an appropriate amount of pure water, thereby preparing an aqueous dispersion of a resin particle 1 containing 20.0% resin particle 1 (in the solid state).

<Preparation of Resin Aqueous Solution>

A styrene-ethyl acrylate-acrylic acid copolymer (resin 1) having an acid value of 150 mg KOH/g and a weight-average molecular weight of 8,000 was prepared. The resin 1 (20.0 parts) was subjected to neutralization with potassium hydroxide the acid value of which is equimolar to that of the resin 1, and added with an appropriate amount of pure water, thereby preparing an aqueous solution of the resin 1 containing 20.0% resin (in the solid state).

<Ink Preparation>

(Preparation of Pigment Dispersion)

A pigment (carbon black) (10.0 parts), an aqueous solution of the resin 1 (15.0 parts) and pure water (75.0 parts) were mixed. The mixture and 0.3-mm-diameter zirconia beads (200 parts) were introduced into a batch-type vertical sand mill (manufactured by AIMEX) and dispersed for five hours while being water-cooled. Afterwards, the solution was subjected to centrifugation for removing coarse particles, and pressure filtration using a cellulose acetate filter (manufactured by ADVANTEC) having a pore size of 3.0 μm, thereby preparing a pigment dispersion K containing a 10.0% pigment and a 3.0% resin dispersant (the resin 1).

(Ink Preparation)

The components shown in Table 6 below were mixed and the mixture was sufficiently stirred and then subjected to pressure filtration using a cellulose acetate filter (manufactured by ADVANTEC) having a pore size of 3.0 μm, thereby preparing the ink. ACETYLENOL E100 (product name) is a surfactant manufactured by Kawaken Fine Chemicals Co., Ltd.

TABLE 6

| Ink composition | |
|---|---|
| | Black ink |
| Pigment dispersion K | 20.0 |
| Aqueous dispersion of resin particle 1 | 50.0 |
| Aqueous solution of resin 1 | 5.0 |
| Glycerol | 5.0 |
| Diethylene glycol | 7.0 |
| ACETYLENOL E100 | 0.5 |
| Pure water | 12.5 |

<Preparation of Transfer Auxiliary Liquid>

The following components were mixed, and the mixture was sufficiently stirred and then subjected to pressure filtration using a cellulose acetate filter (manufactured by ADVANTEC) having a pore size of 3.0 μm, thereby preparing the transfer auxiliary liquid.

An aqueous dispersion of the resin particle 1: 30.0%

An aqueous solution of the resin 2: 3.0%

Glycerol: 5.0%

Diethylene glycol: 4.0%

ACETYLENOL E100 (product name, surfactant, Kawaken Fine Chemicals Co., Ltd.): 1.0%

Ion-exchange water: 57.0%

Since the ink and the transfer auxiliary liquid were applied onto the transfer member applied by the treatment liquid, an intermediate image is formed on the image formation surface of the top layer of the transfer member. In ejection pattern of the intermediate image, 100% solid image pattern in which the solid image having 200 recording duty is formed in the area of 1 cm×1 cm. Additionally, in the image recording apparatus of the present invention, 100% recording duty is defined as the conditions that one drop of 3.0 ng of the ink is dropped to the unit area of 1/1.200 inch×1/1.200 inch by 1.200 dpi×1.200 dpi of resolution. Afterwards, the heating apparatus 203 facing the surface of the transfer member heated the transfer member and the intermediate image. It should be noted that a hot-air heater was used as the heating apparatus. Subsequently, the intermediate image was pressurized on the transfer member through the pressurizing roller 204, and the image was transferred to coated paper (AURORA COAT (product name) manufactured by Nippon Paper Industries Co., Ltd., basis weight 73.5 g/m$^2$) which was used as the recording medium 205.

The temperature of the surface of the transfer member was measured using a radiation thermometer, in the state where the transfer member was heated by the heating apparatus, in the state (just before pressurization using the pressurizing roller) where the recording medium was in contact with the transfer member, and in the state just after the recording medium pressurized using the pressurizing roller was peeled off.

After the transfer member was cleaned, the same image-forming step was repeated 10000 times, and the first image and the 10000th image were evaluated.

The following criteria were used for the evaluation.

AA: The rate of transfer to the recording medium is 95% or more

A: The rate of transfer to the recording medium is 90% or more and less than 95%

B: The rate of transfer to the recording medium is 80% or more and less than 90%

C: The rate of transfer to the recording medium is less than 80%

It should be noted that the rate of transfer to the recording medium was measured by observing the transfer member after the transfer step through an optical microscope, and calculating the remaining area of the intermediate image to calculate [100−(the remaining area of the intermediate image)/(the area of the intermediate image)].

In addition, the surface of the transfer member obtained after forming an image thereon 10000 times was observed using an optical microscope.

The following criteria were used for the evaluation.

A: No crack or other damage is observed in the observed area.

B: Almost no crack or other damage is observed in the observed area.

C: Crack or other damage is observed in the observed area.

Examples 16 to 29

Images were formed in the same manner as in Example 15 except that the transfer members A to N were used and a near infrared ray heater (ZKB600/80G (product name) manufactured by Heraeus) having a peak wavelength of 1500 nm was used as the heating unit, and evaluation was performed.

Tables 7, 8 and 9 show the evaluation results.

TABLE 7

| | | Example 15 | Example 16 | Example 17 | Example 18 | Example 19 | Example 20 |
|---|---|---|---|---|---|---|---|
| | Transfer member | A | A | B | C | D | E |
| | Heating unit | Hot-air heater | Near infrared ray heater | Near infrared ray heater | Near infrared ray heater | Near infrared ray heater | Near infrared ray heater |
| Evaluation | Heating temperature [° C.] | 106 | 110 | 111 | 110 | 117 | 104 |
| | Temperature just before transfer [° C.] | 88 | 93 | 96 | 87 | 87 | 82 |
| | Temperature after transfer [° C.] | 71 | 76 | 80 | 74 | 70 | 72 |

TABLE 7-continued

| | | Example 15 | Example 16 | Example 17 | Example 18 | Example 19 | Example 20 |
|---|---|---|---|---|---|---|---|
| | Transferability (1st image) | A | AA | AA | A | A | A |
| | Transferability (10000th image) | A | AA | A | A | A | A |
| | Transfer member Surface observation | A | A | B | A | A | A |

TABLE 8

| | | Example 21 | Example 22 | Example 23 | Example 24 | Example 25 | Example 26 |
|---|---|---|---|---|---|---|---|
| | Transfer member | F | G | H | I | J | K |
| | Heating unit | Near infrared ray heater | Near infrared ray heater | Near infrared ray heater | Near infrared ray heater | Near infrared ray heater | Near infrared ray heater |
| Evaluation | Heating temperature [° C.] | 111 | 107 | 110 | 111 | 110 | 110 |
| | Temperature just before transfer [° C.] | 96 | 86 | 87 | 88 | 87 | 87 |
| | Temperature after transfer [° C.] | 79 | 73 | 74 | 76 | 74 | 74 |
| | Transferability (1st image) | AA | AA | A | A | AA | AA |
| | Transferability (10000th image) | A | AA | A | A | AA | AA |
| | Transfer member Surface observation | A | A | A | A | A | A |

TABLE 9

| | | Example 27 | Example 28 | Example 29 |
|---|---|---|---|---|
| | Transfer member | L | M | N |
| | Heating unit | Near infrared ray heater | Near infrared ray heater | Near infrared ray heater |
| Evaluation | Heating temperature [° C.] | 117 | 115 | 110 |
| | Temperature just before transfer [° C.] | 95 | 94 | 86 |
| | Temperature after transfer [° C.] | 69 | 72 | 73 |
| | Transferability (1st image) | A | A | B |

TABLE 9-continued

| | | Example 27 | Example 28 | Example 29 |
|---|---|---|---|---|
| | Transferability (10000th image) | B | B | B |
| | Transfer member Surface observation | B | A | B |

Comparative Examples 8 to 15

Images were formed in the same manner as in Examples 15 to 29 except that the transfer members O to U were used, and evaluation was performed.

Tables 10 and 11 show the evaluation results.

TABLE 10

| | | Comparative Example 8 | Comparative Example 9 | Comparative Example 10 | Comparative Example 11 | Comparative Example 12 | Comparative Example 13 |
|---|---|---|---|---|---|---|---|
| | Transfer member | O | P | Q | R | R | S |
| | Heating unit | Near infrared ray heater | Near infrared ray heater | Near infrared ray heater | Near infrared ray heater | Near infrared ray heater | Near infrared ray heater |
| Evaluation | Heating temperature [° C.] | 110 | 117 | 98 | 110 | 127 | 109 |
| | Temperature just before transfer [° C.] | 87 | 82 | 78 | 80 | 95 | 74 |
| | Temperature after transfer [° C.] | 74 | 65 | 66 | 63 | 82 | 62 |
| | Transferability (1st image) | C | B | C | C | A | C |

TABLE 10-continued

| | Comparative Example 8 | Comparative Example 9 | Comparative Example 10 | Comparative Example 11 | Comparative Example 12 | Comparative Example 13 |
|---|---|---|---|---|---|---|
| Transferability (10000th image) | C | B | C | C | C | C |
| Transfer member Surface observation | A | C | B | A | C | A |

TABLE 11

| | | Comparative Example 14 | Comparative Example 15 |
|---|---|---|---|
| | Transfer member | T | U |
| | Heating unit | Near infrared ray heater | Near infrared ray heater |
| Evaluation | Heating temperature [° C.] | 110 | 109 |
| | Temperature just before transfer [° C.] | 91 | 74 |
| | Temperature after transfer [° C.] | 76 | 63 |
| | Transferability (1st image) | C | C |
| | Transferability (10000th image) | C | C |
| | Transfer member Surface observation | A | A |

Example 30

Transfer member V having the physical properties shown in Tables 12 was fabricated in a manner similar to that for the transfer member A by adjusting the content of hollow fine particles added to the heat insulating layer, the content of the masterbatch, and the content of alumina particle and silicon particle as filler.

TABLE 12

| | | Example 30 Transfer member V |
|---|---|---|
| Top layer | Thickness t3 [mm] | 0.005 |
| Heat storage layer | Thickness t2 [mm] | 0.12 |
| | Thermal conductivity λ2 [W/(m · K)] | 0.23 |
| | Volume specific heat C2 [MJ/(m$^3$ · K)] | 1.52 |
| | Modulus of elasticity E2 [MPa] | 11 |
| | 900-2500 nm Absorbency index [%] | 65 |
| Heat insulating layer | Thickness t1 [mm] | 0.5 |
| | Thermal conductivity λ1 [W/(m · K)] | 0.18 |
| | Modulus of elasticity E1 [MPa] | 12 |

Example 31

Images were formed in the same manner as in Example 15 except that the transfer member V was used, and evaluation was performed.

Table 13 show the evaluation results.

TABLE 13

| | | Example 31 |
|---|---|---|
| | Transfer member | V |
| | Heating unit | Near infrared ray heater |
| Evaluation | Heating temperature [° C.] | 114 |
| | Temperature just before transfer [° C.] | 95 |
| | Temperature after transfer [° C.] | 65 |
| | Transferability (1st image) | B |
| | Transferability (10000th image) | B |
| | Transfer member Surface observation | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-138556, filed Jul. 14, 2017, which is hereby incorporated by reference herein in its entirety.

What is claimed is:

1. A transfer member for transfer-type image formation comprising, in this order, a heat insulating layer, a heat storage layer, and a top layer, wherein the transfer member has an image formation surface suitable for forming an intermediate image thereon by application of ink, and wherein when a thickness of the heat insulating layer, a thickness of the heat storage layer, and a thickness of the top layer are represented by t1, t2, and t3, respectively, a thermal conductivity of the heat insulating layer and a thermal conductivity of the heat storage layer are represented by λ1 and λ2, respectively, and a volume specific heat of the heat storage layer is represented by C2, t1, t2, t3, λ1, λ2, and C2 satisfy Expressions 1 to 6:

$0.5\ \text{mm} \le t1 \le 1.5\ \text{mm}$; Expression 1:

$0.05\ \text{mm} \le t2 \le 0.50\ \text{mm}$; Expression 2:

$t3 \le 0.020\ \text{mm}$; Expression 3:

$\lambda 1 \le 0.20\ \text{W/(m·K)}$; Expression 4:

$\lambda 2 \ge 0.23\ \text{W/(m·K)}$; and Expression 5:

$C2 \ge 1.60\ \text{MJ/(m}^3\text{·K)}$. Expression 6:

2. The transfer member according to claim 1, wherein C2 satisfies Expression 7:

$C2 \geq 1.60$ MJ/(m$^3$·K). Expression 7:

3. The transfer member according to claim 1, wherein λ2 and C2 satisfy Expressions 8 and 9:

$\lambda 2 \geq 0.27$ W/(m·K); and Expression 8:

$C2 \geq 1.70$ MJ/(m$^3$·K). Expression 9:

4. The transfer member according to claim 1, wherein λ2 and C2 satisfy Expressions 10 and 11 below:

$\lambda 2 \geq 0.50$ W/(m·K); and Expression 10:

$C2 \geq 2.00$ MJ/(m$^3$·K). Expression 11:

5. The transfer member according to claim 1, wherein when a modulus of elasticity of the heat insulating layer and a modulus of elasticity of the heat storage layer are represented by E1 and E2, respectively, E1 and E2 satisfy Expressions 12 and 13:

0.1 MPa$\leq E1 \leq$10 MPa; and Expression 12:

1 MPa$\leq E2 \leq$60 MPa. Expression 13:

6. The transfer member according to claim 1, wherein the heat storage layer has an absorbency index of 60% or more, the absorbency index being an absorbency index of near infrared rays having a wavelength of 900 nm to 2500 nm.

7. An image-forming method comprising:

forming an intermediate image by applying an ink to an image formation surface of a transfer member;

heating the intermediate image by heating the transfer member from a side of the image formation surface to form a heated intermediate image; and transferring the thus-heated intermediate image to a recording medium, wherein the transfer member contains, in this order, a heat insulating layer, a heat storage layer, and a top layer, and wherein when a thickness of the heat insulating layer, a thickness of the heat storage layer, and a thickness of the top layer are represented by t1, t2, and t3, respectively, a thermal conductivity of the heat insulating layer and a thermal conductivity of the heat storage layer are represented by λ1 and λ2, respectively, and a volume specific heat of the heat storage layer is represented by C2, t1, t2, t3, λ1, λ2, and C2 satisfy Expressions 1 to 6:

0.5 mm$\leq t1 \leq$1.5 mm; Expression 1:

0.05 mm$\leq t2 \leq$0.50 mm; Expression 2:

$t3 \leq$0.020 mm; Expression 3:

$\lambda 1 \leq 0.20$ W/(m·K); Expression 4:

$\lambda 2 \geq 0.23$ W/(m·K); and Expression 5:

$C2 \geq 1.60$ MJ/(m$^3$·K). Expression 6:

8. The image-forming method according to claim 7, wherein the formation of the intermediate image comprises applying a treatment liquid for increasing viscosity of the ink, to the image formation surface.

9. The image-forming method according to claim 7, wherein the heating of the intermediate image is heating of the transfer member by irradiation with near infrared rays having a wavelength of 900 nm to 2500 nm.

10. The image-forming method according to claim 7, wherein the ink is applied to the transfer member by an ink-jet method.

11. An image-forming apparatus comprising:

a transfer member;

an image-forming unit that forms an intermediate image by applying an ink to an image formation surface of the transfer member;

a heating apparatus that heats the intermediate image on the transfer member by heating the transfer member from a side of the image formation surface; and a transfer unit that transfers the intermediate image on the transfer member to a recording medium, wherein the transfer member contains, in this order, a heat insulating layer, a heat storage layer, and a top layer, and wherein when a thickness of the heat insulating layer, a thickness of the heat storage layer, and a thickness of the top layer are represented by t1, t2, and t3, respectively, a thermal conductivity of the heat insulating layer and a thermal conductivity of the heat storage layer are represented by λ1 and λ2, respectively, and a volume specific heat of the heat storage layer is represented by C2, t1, t2, t3, λ1, λ2, and C2 satisfy Expressions 1 to 6:

0.5 mm$\leq t1 \leq$1.5 mm; Expression 1:

0.05 mm$\leq t2 \leq$0.50 mm; Expression 2:

$t3 \leq$0.020 mm; Expression 3:

$\lambda 1 \leq 0.20$ W/(m·K); Expression 4:

$\lambda 2 \geq 0.23$ W/(m·K); and Expression 5:

$C2 \geq 1.60$ MJ/(m$^3$·K). Expression 6:

12. The image-forming apparatus according to claim 11, wherein the image-forming unit comprises a treatment liquid applying apparatus that applies a treatment liquid for increasing viscosity of the ink, to the image formation surface.

13. The image-forming apparatus according to claim 11, wherein the heating apparatus is a heating apparatus that heats the transfer member by irradiation with near infrared rays having a wavelength of 900 nm to 2500 nm.

14. The image-forming apparatus according to claim 11, wherein the image-forming unit comprises an ink applying apparatus that applies the ink to the image formation surface from an ink-jet recording head.

15. The image-forming apparatus according to claim 11, wherein C2 satisfies Expression 7:

$C2 \geq 1.60$ MJ/(m$^3$·K). Expression 7:

16. The image-forming apparatus according to claim 11, wherein λ2 and C2 satisfy Expressions 8 and 9:

$\lambda 2 \geq 0.27$ W/(m·K); and Expression 8:

$C2 \geq 1.70$ MJ/(m$^3$·K). Expression 9:

17. The image-forming apparatus according to claim 11, wherein λ2 and C2 satisfy Expressions 10 and 11:

$\lambda 2 \geq 0.50$ W/(m·K); and Expression 10:

$C2 \geq 2.00$ MJ/(m$^3$·K). Expression 11:

18. The image-forming apparatus according to claim 11, wherein when a modulus of elasticity of the heat insulating layer and a modulus of elasticity of the heat storage layer are represented by E1 and E2, respectively, E1 and E2 satisfy Expressions 12 and 13:

$$0.1\ \text{MPa} \leq E1 \leq 10\ \text{MPa}; \text{ and} \qquad \text{Expression 12:}$$

$$1\ \text{MPa} \leq E2 \leq 60\ \text{MPa}. \qquad \text{Expression 13:}$$

19. The image-forming apparatus according to claim 11, wherein the heat storage layer has an absorbency index of 60% or more, the absorbency index being an absorbency index of near infrared rays having a wavelength of 900 nm to 2500 nm.

* * * * *